US005655226A

United States Patent [19]

Williams

[11] Patent Number: 5,655,226

[45] Date of Patent: Aug. 12, 1997

[54] ARTICLE OF WATERPROOF, BREATHABLE APPAREL AND THE METHOD OF MAKING SAME

[76] Inventor: Cole Williams, 2408 Allanjay Pl., Glendale, Calif. 92108

[21] Appl. No.: 413,532

[22] Filed: Mar. 30, 1995

Related U.S. Application Data

[63] Continuation-in-part of Ser. No. 72,975, Jun. 4, 1993, Pat. No. 5,402,540 , which is a continuation-in-part of Ser. No. 959,115, Oct. 9, 1992, Pat. No. 5,483,703 .

[51] Int. Cl.[6] ..... A41B 11/00

[52] U.S. Cl. ..... 2/239; 156/212; 12/142 G; 2/243.1

[58] Field of Search ..... 2/239, 409, 87, 2/243.1, 158, 159, 161.7, 167, 164; 156/212, 213, 306.6, 308.2, 309.6, 322, 292, 290, 148; 264/222; 36/4, 9 R, 10; 12/142 G

[56] References Cited

U.S. PATENT DOCUMENTS

| | | | |
|---|---|---|---|
| 4,194,041 | 3/1980 | Gore et al. | 2/82 |
| 4,310,373 | 1/1982 | Schuhmacher et al. | 156/308 |
| 4,679,257 | 7/1987 | Town | 2/164 |
| 4,809,447 | 3/1989 | Pacanowsky et al. | 36/9 R |
| 4,845,862 | 7/1989 | Phillips, Jr. et al. | 36/9 R |
| 5,325,541 | 7/1994 | Willard | 2/239 |
| 5,430,896 | 7/1995 | Bisley | 2/239 |

*Primary Examiner*—C. D. Crowder
*Assistant Examiner*—Shirra L. Jenkins
*Attorney, Agent, or Firm*—James E. Brunton

[57] ABSTRACT

Articles of clothing and the method of making the same which will allow water vapor due to perspiration to transpire through the article but will prevent liquid water from external sources from reaching the wearer's foot. The articles made by this method of the invention include socks and gloves which are of three-ply construction with the inside and outside plies being knit and the intermediate ply being made from an elastomeric polyurethane film. The three plies are uniquely bonded together using a pliant, waterproof adhesive.

20 Claims, 4 Drawing Sheets

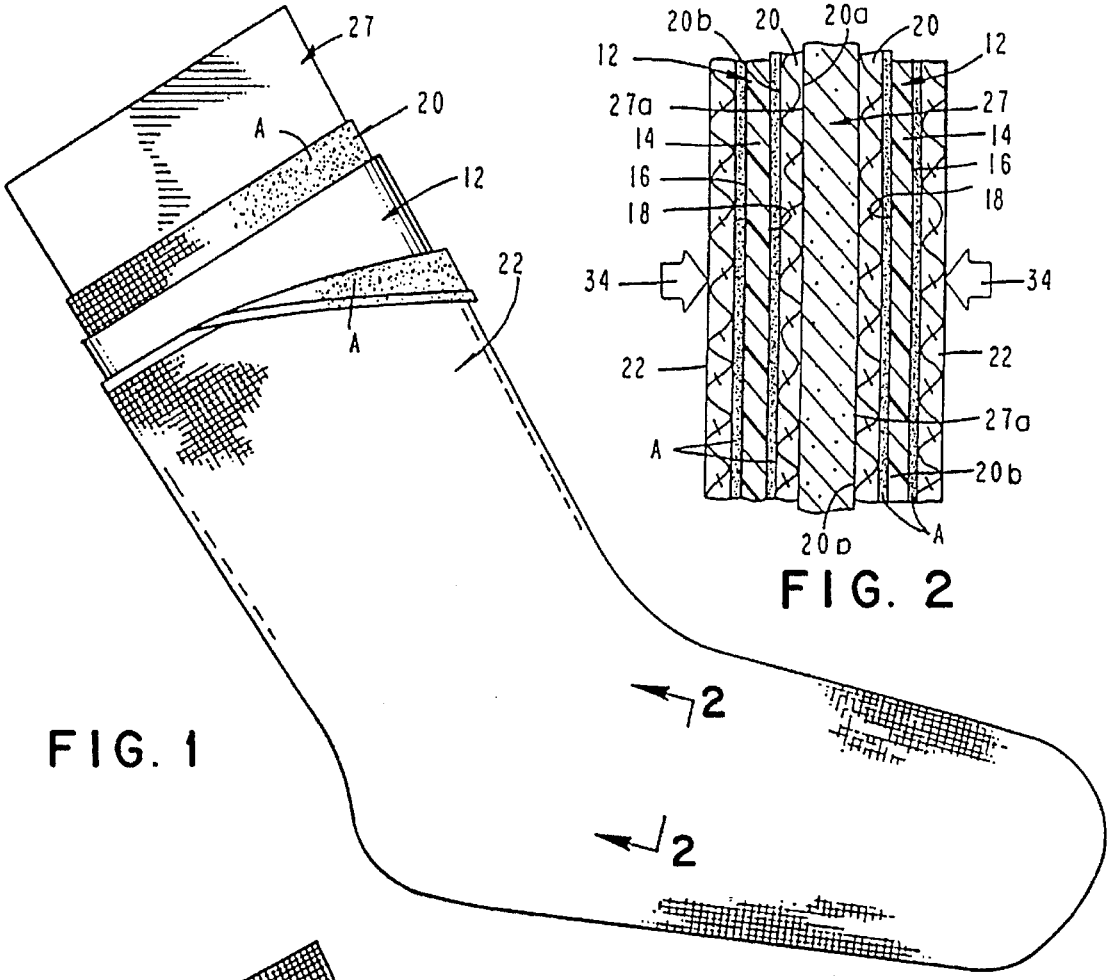
FIG. 1
FIG. 2
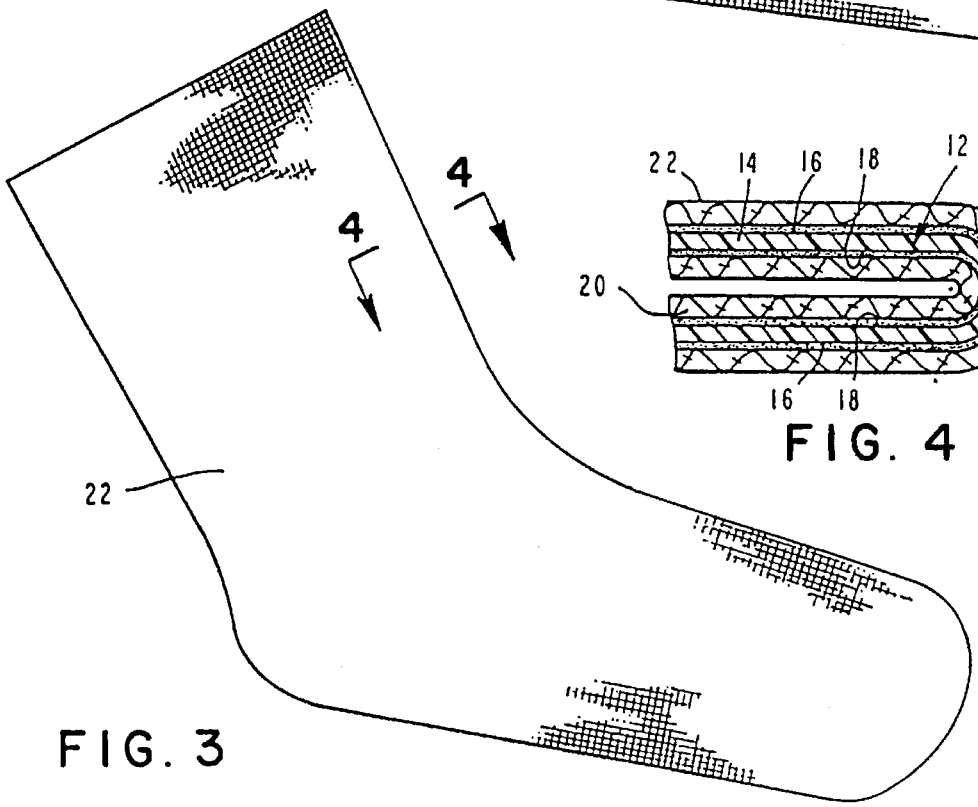
FIG. 3
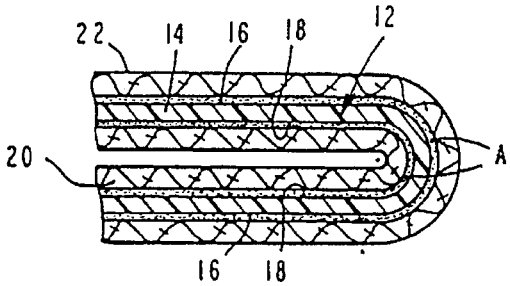
FIG. 4

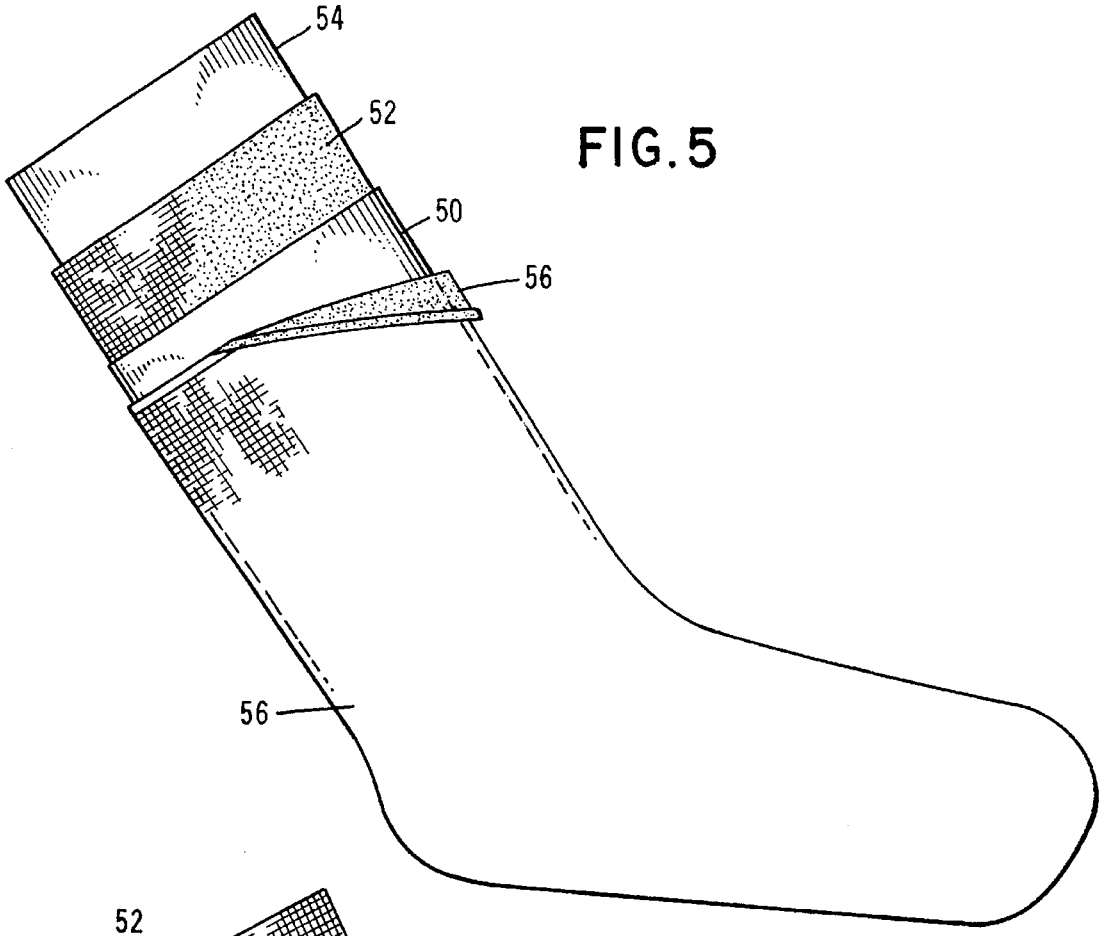
FIG. 5
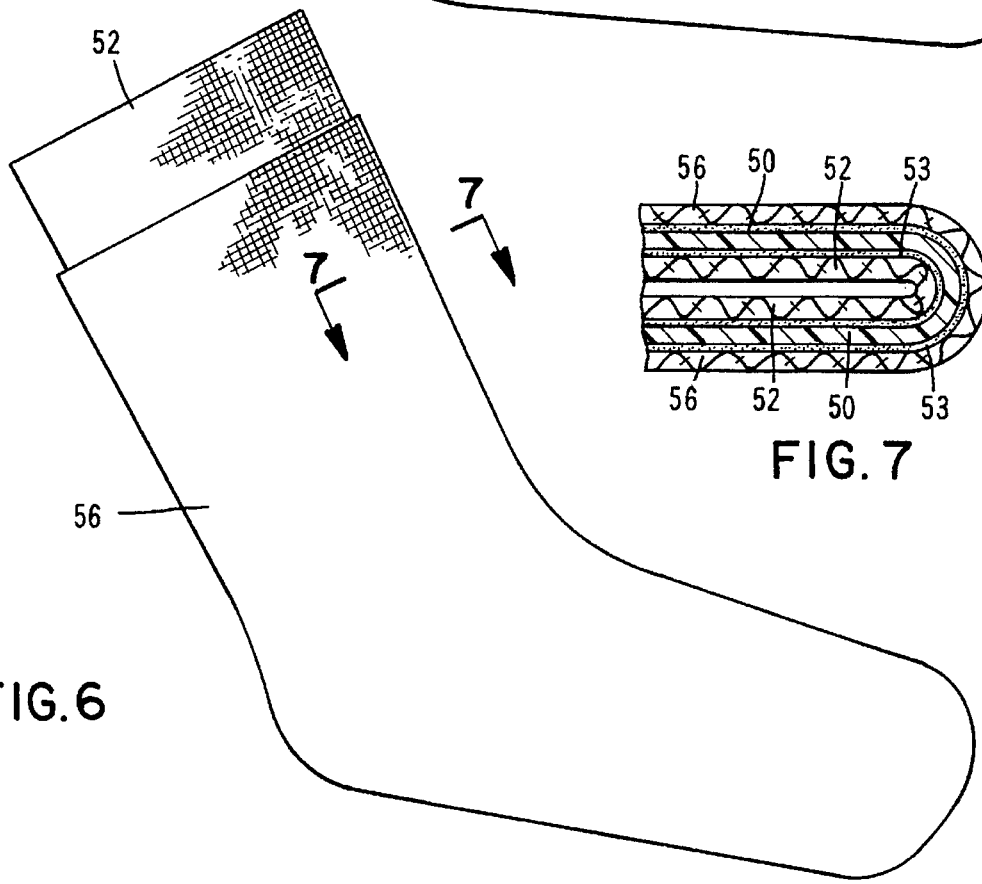
FIG. 6
FIG. 7

ARTICLE OF WATERPROOF, BREATHABLE APPAREL AND THE METHOD OF MAKING SAME

This is a Continuation-In-Part of application, Ser. No. 08/072,975 filed Jun. 4, 1993, now U.S. Pat. No. 5,402,540 which is a Continuation-In-Part of application Ser. No. 07/959,115 filed Oct. 9, 1992 which is now U.S. Pat. No. 5,483,703.

BACKGROUND OF THE INVENTION

1. Field of the Invention

The present invention relates generally to articles of apparel. More particularly, the invention concerns articles of apparel used to cover the wearer's extremities such as an improved, waterproof sock that will permit perspiration to transpire through the sock, but will keep water from external sources away from the wearer's foot.

2. Discussion of the Invention

Various attempts have been made in the past to produce breathable, waterproof articles of apparel such as gloves and socks that will keep the wearer's hands and feet dry and at the same time permit perspiration to transpire through the article. Materials which will accomplish this desired function have been known for sometime. For example, U.S. Pat. No. 3,953,566 discloses a method of making an expanded polytetrafluoroethylene (PTFE) that possesses the properties of being both breathable and waterproof. An improvement of this material is described in U.S. Pat. No. 4,194,041. While both of these materials have been used in the construction of footwear, they exhibit the drawback that they have limited stretchability, thereby making them less than ideally suited for construction of footwear such as socks. In addition, such footwear typically has sewn seams and tapes which make it bulky and uncomfortable.

In an apparent attempt to overcome the problems discussed in the preceding paragraph, a multi-component sock type article was suggested. This article, which is described in U.S. Pat. No. 4,819,447 issued to Pacanowsky, et al., comprises a waterproof, nonelastic, non-stretch sole component, a non-stretch calf component and a vamp component attached to the sole and calf components.

As will be better appreciated from the discussion which follows, the footwear article of the present invention provides, for the first time, footwear such as socks construction which exhibit the comfort and stretchability of a traditional type of sport sock and at the same time are both breathable and completely waterproof.

SUMMARY OF THE INVENTION

It is an object of the present invention to provide comfortable articles of apparel and the method of making the same which will allow water vapor due to perspiration to transpire through the article but will prevent water from external sources from reaching the wearer's extremities.

A particular object of the invention is to provide a footwear article of the aforementioned character which fits well, is pliant and is durable in use.

Another object of the invention is to provide an article such as a glove or sock in which water vapor from perspiration can be transmitted from inside to outside so that the natural evaporative cooling effect can be achieved.

Another object of the invention is to provide a method of making articles of the character described in the preceding paragraphs which is simple and straight forward, does not require the use of complicated equipment such as sewing and seaming equipment and can be performed by unskilled workmen with a minimum of training.

A particular object of the invention is to provide a sock as described in the preceding paragraphs which is of simple construction and is easy to manufacture.

In its preferred form, the footwear article of the invention comprises a sock which is of three-ply construction with the inside and outside plies being knit and the intermediate ply being made from an elastomeric polyurethane film. The three-plies are uniquely bonded together using a pliant, waterproof adhesive.

BRIEF DESCRIPTION OF THE DRAWINGS

FIG. 1 is a side-elevational view illustrating the method of making the footwear article of the invention and showing the components of the article in position over a foot-shaped planar mandrel.

FIG. 2 is an enlarged cross-sectional view taken along lines 2—2 of FIG. 1.

FIG. 3 is a side-elevational view of one form of the footwear article of the invention.

FIG. 4 is an enlarged cross-sectional view taken along lines 4—4 of FIG. 3.

FIG. 5 is a side-elevational view illustrating the method of making an alternate form of the footwear article of the invention and showing the components of the article in position over a foot-shaped planar mandrel.

FIG. 6 is a side-elevational view of the completed alternate form of the footwear article of the invention of FIG. 5.

FIG. 7 is an enlarged, cross-sectional view taken along lines 7—7 of FIG. 6.

DESCRIPTION OF THE INVENTION

Figure 8:
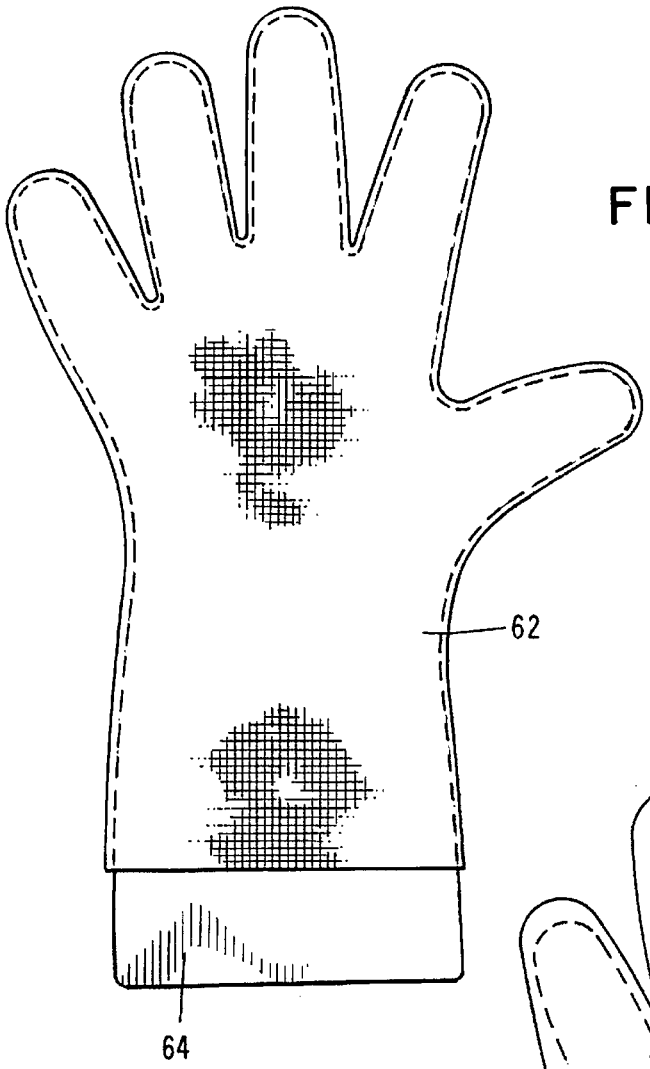
FIG. 8 is a top plan view illustrating the method of making the glove of the invention and showing the inner liner of the glove in position over a hand-shaped planar mandrel.

In the description which follows:

The term "breathable" means the ability of an article to transport interior moisture vapor to the external environment.

As used herein, the term "waterproof" means the ability of an article to substantially prevent liquid water from external sources from reaching the interior of the article.

Similarly, the term "fabric" as used herein means a sheet structure made from fibers, filaments or yarns. Non-limiting examples include woven or nonwoven sheets made by weaving, knitting, felting, hydroentangling or meltblowing fibers, filaments or yarns.

The term "sock" as used herein means a short, close-fitting covering for the foot and lower leg constructed from any suitable material such as natural and synthetic fibers.

Referring to the drawings, FIGS. 3 and 4 show one form of the clothing article of the present invention. The article here comprises a sock construction including a thin, pliant bladder 12 constructed from a waterproof, breathable material, such as polyurethane sheet. The polyurethane sheet can be of various thickness as, for example, between about 0.5 mils and about 3 mils. Bladder 12 includes a foot portion 14 having an outer surface 16 and an inner surface 18. Bladder 12 has the unique capability of generally conforming to the contours of the human foot so that it can be comfortably worn inside a boot or shoe.

Bonded to the inner, surface 18 of the elastomeric bladder is a light-weight covering member such as a fabric inner sock 20 of standard construction which is preferably made from knitted natural or synthetic fibers.

The article of the invention shown in FIG. 3 also includes an outer sock 22 which is bonded to the outer surface of bladder 12. Outer sock 22 can also be constructed from filament or spun yarns. The sock can also be constructed from natural fibers; such as wool fibers, or from a variety of synthetic fibers such as polyester nylon and combinations thereof.

Inner sock 20 and outer sock 22 are preferably bonded to bladder 12 by means of a waterproof, heat activated adhesive. A hot melt adhesive in powder form sold by Bostik, Middleton, Mass., product #5116, a polyester type, has proven satisfactory for this purpose. Other adhesives can, of course, also be used, including breathable adhesives. In any event, the adhesive should be selected and applied in a manner that the breathability of the footwear is not destroyed or substantially reduced.

For certain applications the footwear article of the invention can be constructed by bonding to the bladder only a single inner or outer sock. This two, rather than three-ply construction, can be used in a number of applications in which the three or more ply constructions are too bulky or too expensive.

The thin pliant, thermoplastic material from which the waterproof, breathable bladder will be made is of a character that will prevent penetration of liquid water while at the same time permitting free passage of moisture vapor such as perspiration. This material can be a polyurethane sometimes described as thermoplastic urethane. A suitable material of this type is sold by Fabrite Laminating Corp. of Woodridge, N.J. Other suitable materials include elastomers made from polyesters, copolyesters, polyamides, cellulose derivatives, polyacrylic acid and its hololog, natural or synthetic rubber with hydrophilic impurities, copolyozamides, polyureas, polyelectrolytes, polyphosphates, polyvinylamid, polyvinylalcohol, polyether, and copolymers thereof, polythioether, polythioether-polyether, copolyepichlorohydrin-ether, polysulphosphates, copolyester-ether and derivatives or mixtures thereof.

Considering now the method of the invention, the thin, pliant bladder material is first coated with a light coating of the powdered hot melt adhesive, Bostik #5116. The adhesive particles randomly cover the bladder evenly to a density of about 20% coverage of the surface area. This bladder material with adhesive is then heated to a temperature slightly above the softening point of the adhesive, thereby causing the discrete particles of adhesive to fuse to the surface of the bladder material. In the case of Bostik #5116, the softening point is 268 degrees Fahrenheit. This means is also used to coat particles of adhesive on both sides of the bladder material.

The next step is the construction of the waterproof, breathable bladder. In one form of the method of the invention this is accomplished by overlaying two sheets of the previously described adhesive coated bladder material and to define on the sheets of material a line circumscribing the boundary of the bladder. This done, the sheets of material are heated along the boundary line to a temperature sufficient to sealably bond the sheets together along the boundary line.

The heating-fusion step can be accomplished in several ways well known to those skilled in the art, including using a heated wire or die having the shape of the bladder-boundary. Heating can also be accomplished through the use of well-known radio frequency and ultrasonic welding techniques.

One technique which has proven to be satisfactory in making the footwear of the invention, involves the use of a heated platen press embodying a die having the shape of the outer boundary of the bladders. The die is electrically heated to about 500 degrees Fahrenheit. One of the cooperating platens of the platen press is maintained at room temperature and, is lined with a flexible fabric such as felt. The two sheets of the adhesive-coated bladder material are placed between two sheets of polytetrafluoroethylene coated fiber glass sheets which act as separator material and also allow the heat from the die to penetrate to the film. Appropriate heating of the dies causes the sheets of bladder material to be effectively welded, or sealably joined together along the boundary line to make the sock-shaped bladder. After the welding process, the excess material outside the bladder boundary is manually stripped away and the bladder is removed from the platen press. By these means, a sock-shaped bladder component with discrete particles of hot melt adhesive both inside and outside has been produced.

It is to be noted that the proper application of the adhesive to the inner and outer surfaces of the bladder is critical to the success of the manufacturing process, since, when completed, the sock must be breathable, flexible, pliant and waterproof and it must withstand laundering and physical abuse while being worn. It is to be noted that the adhesives can also be applied to the fabric components as an alternative means of construction.

As illustrated in FIGS. 1 and 2 of the drawings, the next step in the process of the invention is to place the first covering member, or inner sock 20 over a generally foot-shaped, approximately ⅛th inch thick, generally planer mandrel 27. Inner sock 20, which has inner and outer surfaces **20*a* and 20*b* is placed over the mandrel so that inner surface 20*a* thereof is disposed in engagement with the faces 27*a* of mandrel 27. As previously discussed, inner sock 20** can be constructed from a variety of materials. However, a sock which is made by Wigwam Mills, Inc. of Sheboygan, Wisc. special knit pattern of its standard BK-1188 has proven satisfactory. An alternate inner sock, also made by Wigwam, is intended to impart cold weather comfort to the waterproof footwear article of the present invention depending on the climate encountered. For cold weather comfort, the inner sock can be made utilizing Thermax® made by E. I. duPont de Nemours and Co. of Wilmington, Del. For warm weather comfort the inner sock can be made utilizing Coolmax® made by duPont.

After inner sock 20 has been placed over mandrel 27 and smoothed out so that its inner surface is in close engagement with the faces of the mandrel 27, the bladder 12, which has been adhesive coated with particles of hot melt adhesive inside and outside is carefully placed over the assemblage of inner sock 20 and mandrel 27. The bladder is smoothed to be in close engagement with the outer surface of inner sock 20. Outer sock 22 is placed over both the inner sock 20 and the adhesive coated bladder assemblage on mandrel 27.

The precursor assembly comprising first inner sock 20, the adhesive coated bladder 12 and the second outer sock 22 is then heated and compressed in the direction of the arrows 34 in FIG. 2 to form the finished article. This step is accomplished by placing the mandrel, upon which the precursor assembly is mounted, between two platens which can be controllably heated and urged together. More particularly, the platens are preferably electrically heated to a temperature of about 280 degrees Fahrenheit and are controllably moved into pressural engagement with the precursor assembly by any type of hydraulically actuated pressure imparting assembly of a character well known to those skilled in the art. A commercially available press suitable for carrying out the method of the invention is sold by PHI of the City of Industry, Calif. During this temperature-pressure step, the heat activated adhesive is thereby fused making a permanent, water resistant bond of inner sock 20 to one side of the bladder and the outer sock 22 to the other side of the bladder. The minimum temperature required to activate the Bostik #5116 adhesive is 268 degrees Fahrenheit. Accordingly, a temperature range of between about 270 degrees Fahrenheit and 290 degrees Fahrenheit is preferred.

The precursor assembly is then removed from the press and allowed to cool thoroughly prior to doffing the completed waterproof footwear article from the mandrel.

When removed from the mandrel, the footwear article is generally planar in shape. However, upon inserting the foot into the open cuff of the article, the foot engaging portion of the sock will neatly and smoothly conform to the shape of the wearer's foot.

Depending upon the end use of the article, other commercially available adhesives can also be used in the practice of the method of the invention. By way of example, these include an adhesive sold by Stahl U.S.A. of Peabody, Mass. under the designation UE-4172 and an adhesive sold by Reichhold Chemicals, Inc. under the product code EA 6494. Further, a mixture of the Reichhold EA 6494 and a SOLUCOTE® 1024 adhesive made by Soluol Chemical Co., Inc. can be used for some end product applications.

When the adhesive used is in liquid form it can be sprayed, brushed or otherwise applied to the elastomeric bladder or sock fabric. As previously stated when the adhesive is applied to the bladder it must be applied in the manner, such as a dot matrix coating, which will not degrade the breathability characteristics of the bladder material.

An alternate form of the method of the invention will next be considered. This form of the invention is similar in many respects to the method described in the preceding paragraphs. However, in this latest form of the invention a different powdered adhesive is used and, importantly, the bladder and the outer sock are both wetted with water during the assembly step to expedite the assembly of the members and to improve the integrity of the finished product.

In the practice of this alternate form of the invention, the thin, pliant bladder material or membrane is first coated with a light coating of a powdered hot melt adhesive sold under the name and style of Bostik #5182. The adhesive is uniformly distributed over the membrane material preferably at the rate of about 16.5 grams per square yard and is thermally fused to the membrane in the manner previously described. The second side of the membrane material is similarly coated and fused with Bostik #5182 at a rate of about 16.5 grams per square yard. To develop a properly sealed final lamination, the fusing of the adhesive to the membrane must be done with great care to carefully control the radiant heating of the adhesive coated membrane. Too high a temperature will cause the membrane to melt, while too low a temperature will fail to adequately melt and bond the adhesive particles to the bladder surfaces.

Following the coating of the membrane surfaces with Bostik #5182, the next step in this alternate method of the invention is accomplished by cutting the coated membrane into first and second segments and overlying the first and second segments to form a coated assembly. Next, a line is formed on the coated assembly which circumscribes the boundary of the bladder which generally corresponds to the extremity to be covered, in this case the human foot. This done, the sheets of material are heated along the boundary line to a temperature sufficient to sealably bond the sheets together along the boundary line.

This heating-fusion step is here accomplished using a heated platen press embodying a die having the shape of the outer boundary of the bladders. The aluminum die is electrically heated to about 530 degrees Fahrenheit. The two sheets of the adhesive coated bladder material are placed between two sheets of polytetrafluoroethylene (said under the mark TEFLON coated fiber glass sheets which act as separator material and also allow the heat from the die to penetrate to the film. Appropriate heating of the dies causes the sheets of bladder material to be effectively welded, or sealably joined together along the boundary line to make the sock-shaped bladder. During the welding step, the assemblage is backed by a ½ inch thick sheet of temperature hardboard and a pressure is exerted on the assemblage sufficient to cleanly pinch off the membrane material surrounding the die.

As illustrated in FIGS. 1 and 2 of the drawings, the next step in the alternate process of the invention is to place the first covering member, or inner sock 20, over a generally foot-shaped, approximately ⅛th inch thick, generally planer mandrel 27. Inner sock 20, which has inner and outer surfaces, is disposed in engagement with the faces 27*a* of mandrel 27. As previously discussed, inner sock 20 can be constructed from a variety of materials. Mandrel 27 can also be constructed of various materials but here is formed a sheet of aluminum having a thickness of about 0.032 inches. The edges of the mandrel are smoothed and rounded and preferably coated with a thin strip of TEFLON which may comprise a ½ inch wide strip of pressure sensitive adhesive coated TEFLON tape.

After inner sock 20 has been placed over mandrel 27 and smoothed out so that its inner surface is in close engagement with the faces of the mandrel 27, the bladder 12, which has been adhesive coated with particles of hot melt adhesive inside and outside is immersed in water causing it to expand slightly. The water saturated, expanded bladder is then carefully placed over the assemblage of inner sock 20 and mandrel 27. The bladder is smoothed to be in close engagement with the outer surface of inner sock 20. Outer sock 22 is then also wetted by immersing it in water or otherwise wetting it and is carefully placed over both the inner sock 20 and the adhesive coated bladder assemblage on mandrel 27.

The precursor assembly comprising first inner sock 20, the adhesive coated bladder 12 and the outer sock 22 is then placed between heated platens and heated to about 275 to 325 degrees F. for about three to five minutes. Preferably the bottom platen is a rigid sheet of aluminum covered with a ¼ inch thick sheet of about 50 derometer silicone rubber. The heated assemblage is then compressed by substantial compressive force in the direction of the arrows 34 in FIG. 2 to form the finished article.

The compressive forces can be exerted on the heated precursor assembly in various ways such as hydraulically-actuated, pressure-imparting assembly, or press, previously described herein. Alternatively, the compressive forces can be applied by passing the precursor assembly between pressing rollers of a character well known to those skilled in the art. Preferably, a pressure of at least two pounds per square inch is exerted on the precursor assembly for about four minutes. Following the compression step, the precursor assembly is immediately plunged into a bath of cool water for several minutes. This step quenches the adhesive, arresting crystalline growth and thereby providing a more amorphous molecular structure and pliant adhesion. Additionally, the bladder is softened and expanded by the water for ease of removal from the mandrel. The wet sock assemblage is then removed from the mandrel and allowed to dry.

Referring now to FIGS. 5, 6, and 7, still another form of the method and article of the invention is there illustrated. This form of the invention is similar in many respects to that earlier described. However, in this latest form of the method of the invention, still a different adhesive is used. The bladder material is changed and the time and temperature parameters of the laminating process are changed. Additionally, several new steps have been added to the method earlier described. Further, the inner, liner sock is provided with a longer cuff to provide a novel wicking action.

In the practice of this latest form of the method of the invention, the thin, pliant bladder material or membrane 50 comprises an extruded film made by The Dow Chemical Company and sold under the name and style "PELLETHANE No. 2103-89AE". The membrane, which comprises polytetramethylene glycol ether, is preferably about 0.001 inches thick is first coated with a light coating of a powdered hot melt adhesive sold under the name and style of Bostik HM 5184-AB which is available from Bostik, Inc. of Middleton, Mass. This particular adhesive is a powdered hot melt adhesive with a low activation temperature of about 260 Fahrenheit. The particle size is such as can be sieved through a mesh with approximately 200 micron apertures.

In carrying out the method of the invention, the adhesive is uniformly distributed over the membrane material preferably at the rate of about 16.5 grams per square yard and is thermally fused to the membrane by passing a radiant heater over the adhesive-coated membrane. In practice, the radiant heater is controllably passed over the adhesive coated membrane in a manner to elevate the temperature of the adhesive above its melting point, thereby fusing the adhesive to the membrane without melting the membrane. More particularly with the temperature of the heater set at about 764 degrees Fahrenheit, the heater is preferably passed over the assemblage at a rate of travel of about 92 inches per minute. During this step, the face of the radiant heater is preferably positioned about 2 ¼ inches above the membrane. The membrane with adhesive fused to one side is then turned over with the uncoated side facing up. Again, a coating of the powdered adhesive is distributed on the second side of the membrane and is fused to the membrane in the manner just described, thus providing a membrane with adhesive particles fused uniformly to both sides.

Following the coating of the membrane surfaces with adhesive 53, the next step in this latest method of the method of the invention is accomplished by means of a thermo plastic welding process which is carried out in a suitable platen press. More particularly, in accomplishing this welding step, the bottom platen of the press is preferably covered with a thin sheet of silicone rubber of about 70 shore hardness. This layer is in turn covered with a sheet of fiberglass material which has been coated with a fluorocarbon polymer. This done, two thicknesses of the adhesive coated membrane are laid together and placed onto the bottom platen of the press. A second sheet of fluorocarbon polymer coated fiberglass material is next placed over the sheet of adhesive coated membrane. The upper platen of the press which is equipped with a die in the desired shape of the sock is then heated and controllably forced against the two thicknesses of adhesive coated membrane which are resting on the lower platen of the press. The lower platen is not heated and remains at room temperature. The welding press is equipped with controls so adjustments may be made to vary temperature, dwell times and the force imposed by the platens one against the other.

Disposed between the upper and lower platens is a movable heat shield which protects the adhesive coated membranes from the heat of the upper platen as it is forced into juxtaposition with the lower platen. In this regard, the die is strategically designed to have a depth sufficient to accept the heat shield within the sock shape and effectively prevent the two thicknesses of adhesive coated bladder material from welding one to the other. Suitable process parameters for carrying out the membrane welding step are:

a) Upper platen temperature 572 to 625 degrees Fahrenheit;

b) Dwell time 2.5 to 3.5 seconds; and c) Inter-platen force 2800 to 3200 pounds.

Adherence to these process parameters, causes the sheets of bladder material to be effectively welded, or sealably joined together along the boundary line to make the continuous surface sock-shaped bladder.

It is to be understood that in constructing the bladder, any of the previously described bladder materials and any of the previously described adhesives could be used so long as the process parameters are appropriately adjusted.

Following formation of the sock-shaped bladder, the first covering member, or inner sock 52 (FIG. 7) is placed over a generally foot-shaped, aluminum mandrel 54 (FIG. 5), which has a thickness of about 1/32 inch. In this instance, the inner sock is constructed from a fabric comprising a polyester fiber and a texturized nylon fiber. A suitable, commercially available material for constructing the inner sock is one sold by DuPont under the name and style "COOLMAX". One reason for selecting this particular material is the excellent water-wicking characteristics exhibited by the fibers, the importance of which will presently be described.

After inner sock 52 has been placed over mandrel 54 and smoothed out so that its inner surface is in close engagement with the faces of the mandrel 54, the bladder 50 which has been adhesive coated with particles of hot melt adhesive inside and outside is carefully placed over the assemblage of inner sock 52 and mandrel 54. Outer sock 56 is then placed over both the inner sock 52 and the adhesive-coated bladder.

The precursor assembly comprising inner sock 52, the adhesive coated bladder 50 and the outer sock 56 is then smoothly arranged over the aluminum mandrel with sock 52 against the mandrel, sock 56 on the outside and adhesive coated bladder 50 disposed intermediate the first and second socks.

The precursor assembly is next laminated using a commercial platen press of the character having a controllably heatable upper platen. Suitable process parameters for the lamination step are:

(a) Platen temperature—260 degrees Fahrenheit minimum;

(b) Platen pressure—1 to 2 pounds per square inch; and (c) Dwell time—1 to 3 minutes.

After completion of the laminations step, the laminated precursor assembly is pulled from the mandrel and allowed to cool to room temperature. During cooling, the precursor assembly normally shrinks to a size only minimally smaller than the size of the mandrel.

An optional step in this latest method of the invention is to inflate the laminated precursor assembly with several pounds of air pressure and then submerge it in water in order to test it for leaks. Leaks are evidenced if a stream of bubbles emanate anywhere from the sock.

Whether the precursor assemblage is leak tested or not, the assemblage is preferably wetted and then dried in a heated tumble dryer of the character used in a home laundry. This causes the nylon sock to shrink markedly and also causes the assemblage to become quite elastic so that it will comfortably fit feet of differing sizes.

Still another optional step in the method of the invention is to stitch together the inner and outer socks and the bladder at a location proximate the cuff of the assemblage. This tends to stabilize the assemblage and prevent delamination during extended use.

As previously mentioned, the chosen material for the inner liner 52, namely DuPont's Coolmax polyester fiber, is an efficient wicking fiber which rapidly moves water moisture along the fibers. This capillarity action is due in large measure to four longitudinal grooves formed along the length of each fiber. In use it has been observed that the fibers enhance transport of the perspiration over a wide area inside the sock thereby exposing a greater area of the bladder to the moisture source. By thus moving the perspiration along the wicking fibers, the wearer is made much more comfortable than is the case where the inner liner is not constructed from wicking fibers.

When the inner sock is constructed with a longer cuff so that the cuff extends above the bladder and the outer sock in the manner shown in FIG. 6, the perspiration will be drawn upwardly out of the waterproof portion of the sock thereby allowing it to evaporate directly to atmosphere.

Turning now to FIGS. 8 through 11 of the drawings, another form of the clothing article of the present invention is there shown. This article comprises a glove construction including a thin, pliant bladder constructed from any of the waterproof, breathable materials previously identified herein. As before, the bladder can be of various thicknesses ranging from about 0.5 mils to about 3.0 mils. The previously identified extruded material available from the Dow Chemical Company having a thickness of about 1.0 mil has been proven to be quite satisfactory for use in constructing both the sock and glove articles of the invention.

In the practice of this latest form of the method of the invention, the thin, pliant bladder material or membrane is first coated with a light coating of the previously identified, powdered hot melt adhesive sold under the name and style of Bostik HM 5184-AB which is available from Bostik, Inc. of Middleton, Mass. The adhesive is uniformly distributed over the membrane material in the manner previously described herein in connection with the sock embodiments preferably at the rate of about 16.5 grams per square yard and is thermally fused to the membrane by passing a radiant heater over the adhesive-coated membrane as earlier described. The second side of the membrane material is then coated and fused with Bostik HM 5184-AB.

Following the coating of the membrane surfaces with the adhesive, two thicknesses of adhesive coated membrane are laid together and placed onto the bottom platen of a suitable platen press. The upper platen of the press, which is equipped with a die in the shape of the outer contour of a glove of desired size and shape is then heated and controllably forced against the two thicknesses of adhesive coated membrane which are resting on the lower platen of the press. Disposed between the upper and lower platens is a movable heat shield which protects the adhesive coated membranes from the heat of the upper platen as it is forced into juxtaposition with the lower platen. Suitable process parameters for carrying out the membrane welding step are:

(a) Upper platen temperature—572 to 625 degrees Fahrenheit;

(b) Dwell time—2.5 to 3.5 seconds; and (c) Inter-platen force—2800 to 3200 pounds.

Figure 9:
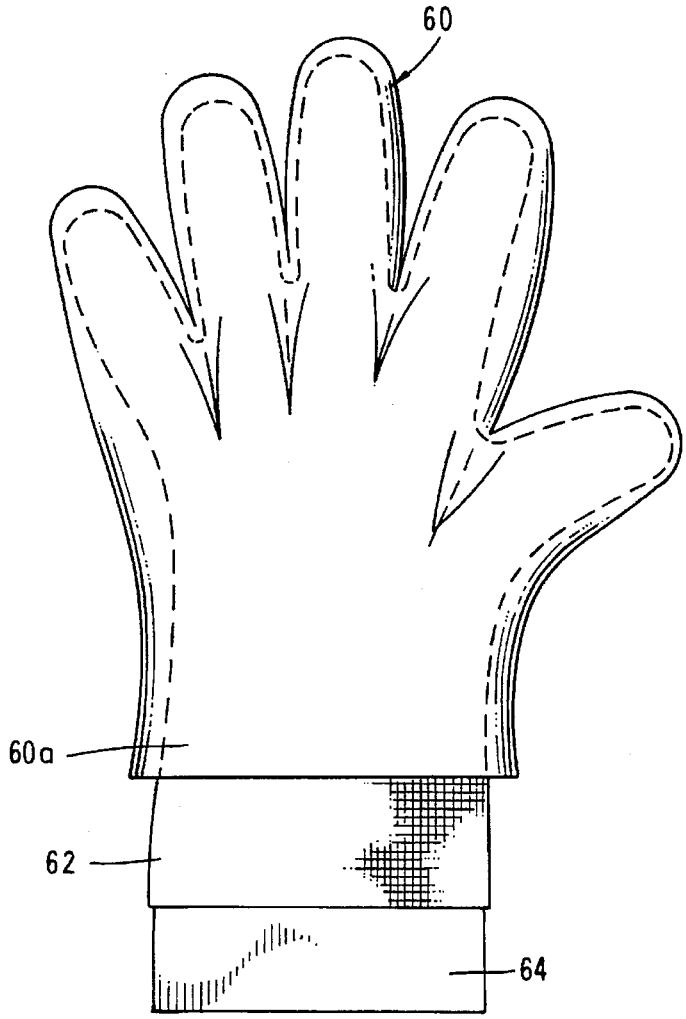
FIG. 9 is a top plan view similar to FIG. 8, but showing the stretchable bladder component of the glove in position over the mandrel and inner liner components.

Adherence to these process parameters, causes the sheets of bladder material to be effectively welded, or sealably joined together along the boundary line to make the glove-shaped bladder 60 (FIG. 9).

In the manner shown in FIG. 8, the first covering member or inner glove 62 is next placed over a generally hand-shaped, aluminum mandrel 64 which is shown by the dotted lines in FIG. 8). Mandrel 64 preferably has a thickness of about 1/32 inch. In this instance, the inner glove is constructed from a fabric comprising a polyester fiber and a texturized nylon fiber. A suitable, commercially available material for constructing the inner glove is a material sold by DuPont under the name and style "COOLMAX".

Referring particularly to FIG. 8, it should be noted that mandrel 64 has the shape of a hand, the fingers and thumb of which have been splayed considerably beyond that which is anatomically comfortable with a human hand. The reason for this exaggerated splaying will be discussed in the paragraphs which follow.

As illustrated in FIG. 9, after glove 62 has been placed over mandrel 64 and smoothed out so that its inner surface is in close engagement with the faces of the mandrel, the bladder 60, which has been adhesive coated with particles of hot melt adhesive inside and outside, is carefully placed over the assemblage of glove 62 and mandrel 64. Outer glove 66 is then placed over both the glove 62 and the adhesive-coated bladder in the manner shown in FIG. 10. Prior to this step, the cuff portion 60*a* of the bladder can, if desired, be trimmed along a line shown by the dotted line 61 in FIG. 10.

Figure 10:
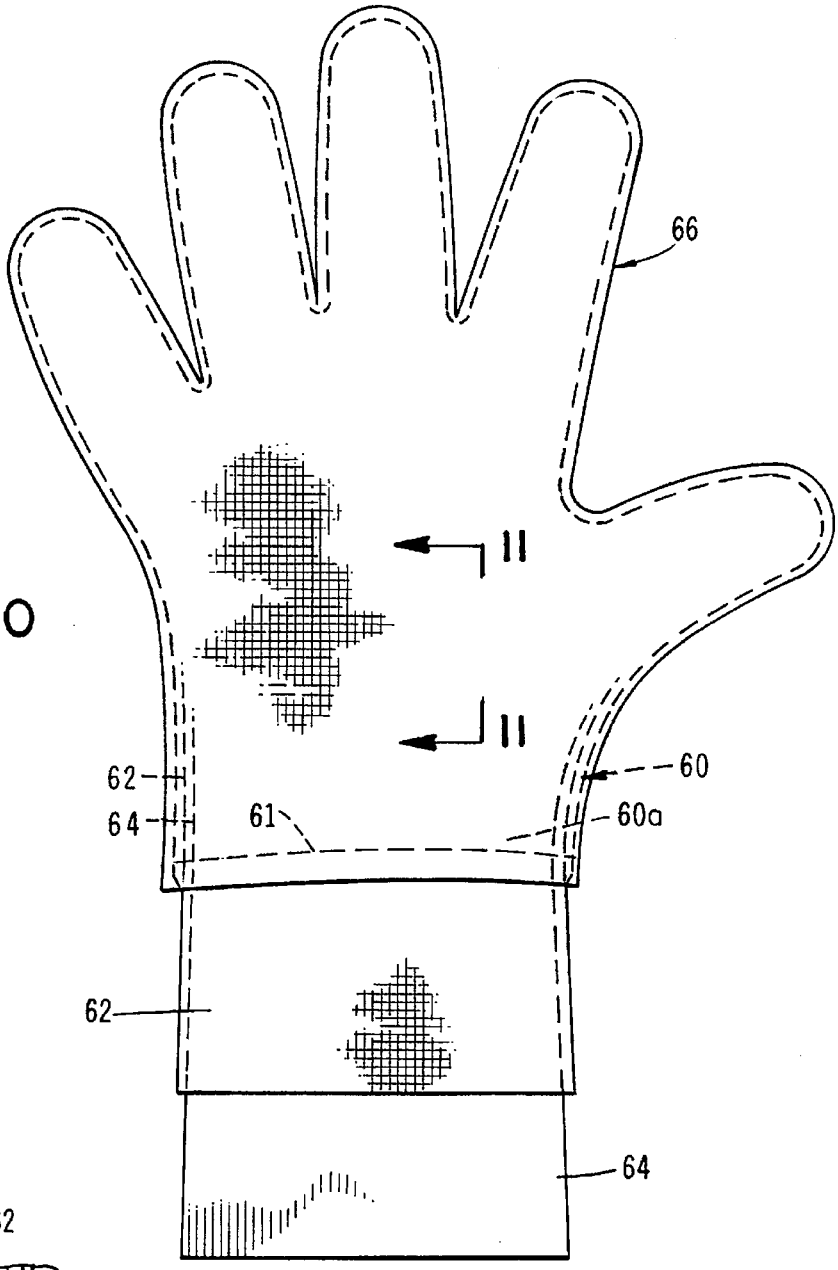
FIG. 10 is a top plan view similar to FIG. 9 but showing the outer covering component of the glove in position over the mandrel, the inner liner and the bladder components.
Figure 11:
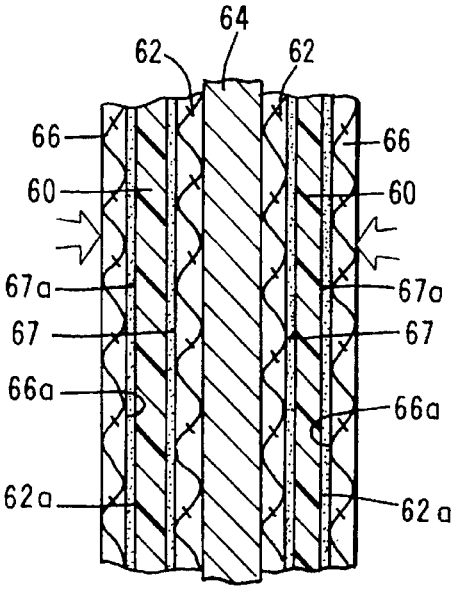
FIG. 11 is an enlarged, cross-sectional view taken along lines 11—11 of FIG. 10

The precursor assembly shown in FIG. 10 comprising glove 62, the adhesive coated bladder 60 and the second glove 66 (see also FIG. 11) is then arranged over the aluminum mandrel. As indicated in FIG. 11, the adhesive 67 which coats the inner surface of bladder 60 is in engagement with the outer surface 62*a* of liner 62. Similarly, the adhesive (designated as 67*a*) which coats the outer surface of the bladder 60 is in engagement with the inner surface 66*a* of outer glove 66. Next, the precursor assembly is laminated using a commercial platen press of the character previously described. Suitable process parameters for the lamination steps are:

(a) Platen temperature—260 Fahrenheit minimum;

(b) Platen pressure—1 to 2 pounds per square inch; and (c) Dwell time—1 to 3 minutes.

After completion of the lamination step, the laminated precursor assembly is pulled from the mandrel and allowed to cool to room temperature. During cooling, the precursor assembly shrinks to a size slightly smaller than the size of the mandrel.

In this regard, it should be understood that when the glove is donned and worn, the material at the crotches is not stretched and ruptured, rather, the material is compressed and folded together between the fingers since the human hand cannot splay wide like the glove, thereby relieving any possibility of damaging stresses. In practice, it is preferable that not only are the fingers and thumb splayed, but also the membrane bladder 60 be fashioned larger than the mandrel 64, as shown in FIG. 9, thereby eliminating further possible stresses upon assembly and insuring a leak-tight glove assemblage.

An optional step in this latest method of the invention is to inflate the laminated precursor assembly with several pounds of air pressure and then submerge it in water to test it for leaks. Leaks are evidenced if a stream of bubbles emanate anywhere from the stock.

Whether the precursor assemblage is leak tested or not, the assemblage is preferably wetted and then dried in a heated tumble dryer of the character used in a home laundry. This causes the nylon glove to shrink markedly and also causes the assemblage to become quite elastic so that is will comfortably fit hands of differing sizes.

As previously mentioned, the chosen material for the glove 62, namely DuPont's Coolmax polyester fiber is an efficient wicking fiber which rapidly moves water moisture along the fibers in the manner earlier described. In use, the fibers enhance transport of perspiration over a wide area inside the glove thereby exposing a greater area of the bladder to the moisture source. By thus moving the perspiration along the wicking fibers, the wearer is made much more comfortable than is the case where the inner liner is not constructed from wicking fibers.

It is to be understood that the method of the invention can be used to produce articles of clothing such as socks and gloves in various sizes and design configurations to fit a wide variety of users.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making an article of apparel used to cover a wearer's extremities comprising the steps of:

(a) forming a waterproof, breathable material into a stretchable bladder having an open cuff portion and an extremity receiving portion having the general shape of the wearer's extremity to be covered and including an outer surface and an inner surface generally conformable to the contours of the extremity to be covered; and (b) bonding a first fabric covering member having the general shape of the wearer's extremity to said inner surface of said extremity receiving portion of said bladder to form a subassembly portion of said article, said fabric covering member having a cuff portion extending beyond said cuff portion of said bladder and being constructed of water-wicking fibers whereby perspiration will be carried toward said cuff portion of said covering member for evaporation to atmosphere.

2. A method as defined in claim 1 including the further step of bonding a second covering member to said outer surface of said extremity receiving portion of said bladder to form a precursor article.

3. A method as defined in claim 1 in which said waterproof, breathable material comprises a thin film.

4. A method as defined in claim 3 in which said first covering member is bonded to said inner surface of said extremity receiving portion of said bladder using a heat activated adhesive.

5. A method as defined in claim 4 including the further step of heating said subassembly.

6. A method of making a waterproof article of apparel constructed of an inner fabric covering, an outer fabric covering and an intermediate pliant, waterproof, breathable bladder having a continuous extremity receiving portion in the general shape of the wearer's extremity, said bladder having a continuous inner and outer surface, said method comprising the steps of:

(a) applying a thin layer of heat activated adhesive over said inner and outer surfaces of said bladder to form a coated bladder;

(b) placing said coated bladder over the inner fabric covering to form a subassembly;

(c) placing the outer fabric covering over said subassembly to form a precursor article; and (d) heating said precursor article to a temperature sufficient to activate said heat adhesive whereby said inner and outer fabric coverings will be adhesively bonded to the continuous inner and outer surfaces of the bladder.

7. A method as defined in claim 6 in which said precursor article is compressed during said heating step in a manner to urge said inner and outer fabric coverings into close proximity with said bladder.

8. A method as defined in claim 6 in which said article of apparel comprises a sock.

9. A method as defined in claim 6 in which said article of apparel comprises a glove.

10. A method as defined in claim 6 in which said inner fabric covering comprises fibers having water-wicking capability.

11. A method of making a waterproof glove constructed of an inner fabric glove, an outer fabric glove and an intermediate pliant, waterproof, breathable bladder having a continuous extremity receiving portion in the general shape of the wearer's hand and having a continuous inner and outer surface said method comprising the steps of:

(a) applying a thin layer of heat activated adhesive over said inner and outer surfaces of said bladder to form a coated bladder;

(b) placing said coated bladder over the inner fabric glove to form a subassembly;

(c) placing the outer fabric glove over said subassembly so that said layer of adhesive on said outer surface of said bladder is proximate the outer fabric glove to form a precursor article; and (d) heating said precursor article to a temperature sufficient to activate said heat adhesive whereby said inner and outer gloves will be adhesively bonded to the continuous inner and outer surfaces of the bladder.

12. A method as defined in claim 11 in which said precursor article is compressed during said heating step in a manner to urge said inner and outer fabric gloves into close proximity with said bladder.

13. A method as defined in claim 11 in which said adhesive comprises urethane polymer and in which said assembly is heated to a temperature sufficient to cross-link said urethane polymer.

14. A method as defined in claim 11 in which said bladder comprises a thin polyurethane film.

15. A glove used to cover a wearer's hand comprising:

(a) an elastomeric, breathable and waterproof stretchable elastic bladder, including as a part thereof a continuous hand receiving portion in the general shape of the user's hand and including a continuous outer surface and a continuous inner surface generally conformable to the user's hand; and (b) inner and outer fabric gloves bonded to said bladder along a substantial portion of said inner and outer surface of said bladder.

16. A glove as defined in claim 15 in which said stretchable, elastic bladder comprises a thin film.

17. A glove as defined in claim 16 in which said inner and outer fabric gloves are bonded to said bladder using a heat activated adhesive.

18. A glove as defined in claim 16 in which said inner fabric glove is constructed from a multiplicity of fibers having water-wicking capabilities.

19. A glove as defined in claim 18 in which said bladder has a cuff portion and in which said inner fabric glove includes a cuff portion extending beyond said cuff portion of said bladder whereby perspiration from the user's hand will be conducted by said water-wicking fibers toward said cuff portion of said inner fabric glove for evaporation to atmosphere.

20. An article of apparel used to cover a wearer's extremity comprising:

(a) an elastomeric, breathable and waterproof, stretchable, elastic bladder, having a cuff portion and including a continuous extremity receiving portion in the general shape of an extremity of the user, said bladder having a continuous outer surface and a continuous inner surface generally conformable to the extremity; and (b) inner and outer fabric coverings bonded to said bladder along a substantial portion of said inner and outer surface of said bladder, said inner fabric covering being constructed from a multiplicity of fibers having water-wicking capabilities and having a cuff portion extending beyond said cuff portion of said bladder whereby perspiration from the user's extremity will be conducted by said water-wicking fibers toward said cuff portion of said inner fabric covering for evaporation to atmosphere.

* * * * *